US005118197A

United States Patent [19]

Ellenberger

[11] Patent Number: 5,118,197

[45] Date of Patent: Jun. 2, 1992

[54] PROCESS FOR MIXING TWO LIQUIDS

[75] Inventor: Peter Ellenberger, Feldmeilen, Switzerland

[73] Assignee: Sandoz Ltd., Basel, Switzerland

[21] Appl. No.: 412,070

[22] Filed: Sep. 25, 1989

[30] Foreign Application Priority Data

Sep. 26, 1988 [CH] Switzerland ..... 03600/88

[51] Int. Cl.[5] ..... B28C 7/04; B01F 15/02

[52] U.S. Cl. ..... 366/8; 366/2; 366/16; 366/40; 366/177

[58] Field of Search ..... 366/2, 3, 8, 5, 16, 366/19, 33, 34, 40, 177, 182, 160, 341, 348; 137/602, 605, 896

[56] References Cited

U.S. PATENT DOCUMENTS

| | | | |
|---|---|---|---|
| 1,541,352 | 6/1925 | Halliburton | 366/5 |
| 3,018,880 | 1/1962 | Brugmann | 366/19 |
| 3,819,157 | 6/1974 | Markfelt | 366/177 |
| 3,976,109 | 8/1976 | Bailey | 366/182 |
| 4,390,281 | 6/1983 | Scriminger | 366/341 |
| 4,498,819 | 2/1985 | El-Saie | 137/896 |
| 4,669,889 | 6/1987 | Yamaguchi et al. | 366/182 |
| 4,818,112 | 4/1989 | Damm et al. | 366/2 |
| 4,881,819 | 11/1989 | Blees | 366/193 |
| 4,964,732 | 10/1990 | Cadeo et al. | 366/177 |

FOREIGN PATENT DOCUMENTS

| | | | |
|---|---|---|---|
| 0243104 | 10/1987 | European Pat. Off. . | |
| 1213633 | 10/1987 | Fed. Rep. of Germany . | |
| 3722258 | 1/1989 | Fed. Rep. of Germany | 366/16 |
| 780253 | 7/1957 | United Kingdom . | |
| 1017786 | 1/1966 | United Kingdom . | |
| 1051306 | 12/1966 | United Kingdom . | |
| 1207746 | 10/1970 | United Kingdom . | |
| 2185902A | 8/1987 | United Kingdom . | |

OTHER PUBLICATIONS

Search Report FR 8912559, Mar. 1991.
Search Report BE 8901024, Mar. 1991.
Search Report UK 8921512.3, Nov. 1989.

*Primary Examiner*—Timothy F. Simone
*Attorney, Agent, or Firm*—Gerald D. Sharkin; Robert S. Honor; Walter F. Jewell

[57] ABSTRACT

An apparatus and a process for mixing water from a pressurized source and an additive or admixture for a cementitious composition in a mixing chamber comprising introducing, in the form of a jet, water under a first pressure, which is above atmospheric pressure, and introducing the additive under a second pressure between atmospheric pressure and the first pressure, the amount of the additive that is introduced to the mixing chamber being controlled by means regulated by the pressure of water.

3 Claims, 3 Drawing Sheets

PROCESS FOR MIXING TWO LIQUIDS

BACKGROUND OF THE INVENTION

The invention relates to a process for mixing two liquids especially a cement mixing water and a cement additive, an apparatus for carrying out the process and the use of the process for the production of aeroconcrete.

It is known to use a jet pump for continuously mixing water with a cement additive to form mixing water, especially with an aeroconcrete additive for the production of aeroconcrete, in which one liquid under pressure is forced through a nozzle to form a jet in a mixing chamber and where a second liquid is drawn by suction into the chamber. However no system has been devised to maintain a constant mixture ratio.

SUMMARY OF THE INVENTION

According to the invention there is provided a process for mixing water from a pressurized source and an additive or admixture (hereinafter referred to as "the additive") for a cementitious composition in a mixing chamber comprising introducing, in the form of a jet, water under a first pressure, which is above atmospheric pressure, and introducing the additive under a second pressure between atmospheric pressure and the first pressure, the amount of the additive that is introduced to the mixing chamber being controlled by means regulated by the pressure of water.

It is an advantage of the present invention that since the liquids are introduced under excess pressure, the mixture ratio is substantially independent of the viscosities of the liquids and an extremely even pore structure of the aeroconcrete can be attained, due to the constant mixing of the foam-forming additive to the water. In particular, this ensures that a particular calculated desired strength of the aeroconcrete can be adhered to.

DESCRIPTION OF THE PREFERRED EMBODIMENTS

Preferably the regulating means are controlled by hydrostatic pressure from the source of water.

In a preferred embodiment of the process of the invention, the additive is displaced from a compartment to the point of mixing and the pressure at mixing is independent of the length of pipe leading from the compartment to the point of mixing.

Preferably the regulating means include a two compartment pressure transmission chamber (58) into the first compartment (70) of which water passes and into the second compartment (72) of which the additive passes.

The additive is preferably introduced into the second compartment (72) from a reservoir (46) by means of discontinuous filling and is displaced from the said compartment (72) by pressure derived from the water. The additive can be either pumped from the reservoir (46) into the said compartment (72) or can be drawn by capillary action.

Preferably the two compartments (70 and 72) are separated by a movable wall (68), whereby in operation the first compartment (70) is filled with mixing water and is expanded or contracted by introduction or removal of said water respectively thereby changing the volume of the second compartment (72), expansion of the second compartment (72) allows additive to be drawn from reservoir (46) and subsequent contraction of the second compartment (72) causes expulsion of the additive to the mixing chamber (40).

Preferably the moveable wall separates the two compartments, such that the second compartment substantially surrounds the first compartment and pressure transmission occurs by change in volume of the first compartment.

Preferably to fill the additive into the second compartment (72) water in the first compartment is withdrawn by a pump action from the pressure transmission chamber (58) thereby decreasing the volume of the first compartment (70) and causing the second liquid to be drawn from a reservoir (46) into the second compartment (72) of chamber (58) by displacing the separating wall (68).

Preferably a constant pressure ratio is achieved across the separating wall (68) by maintaining only fluids in both compartments (70 and 72).

Further according to the invention, there is provided an apparatus for mixing two liquids comprising i) means (10) for transporting a first liquid to a mixing chamber (40)

ii) means (60) for transporting a second liquid to the mixing chamber (40);

iii) a two compartment chamber (58), the first and second compartments (70 and 72) of which are separated by a movable separating wall (68) and iv) a pump (32) connected to the first compartment (70)

whereby the means (60) for transporting a second liquid to the mixing chamber are connected to the second compartment (72) of the chamber (58) so that the second liquid located in the second compartment (72) can be transferred to the mixing chamber (40) in response to an increase in volume of the first compartment (70) that causes a displacement of the movable separating wall (68) and a consequent decrease in volume of the second compartment (72) thereby expelling the second liquid from the second compartment (72); the increase in volume of the first compartment (70) resulting from filling of first liquid into the compartment (70) by passing the first liquid through a suction pump (32) (preferably into a pipe (74) attached at one end to the first compartment (70) and at the other end to the pump (32)) to the first compartment (70), the pump (32) being such as to allow flow in the pipe into the first compartment (70) [preferably without creating any back suction] and the pump (32) effecting removal of the first liquid by suction from the first compartment (70) when the pump (32) is activated.

Preferably the pump is a jet pump.

Preferably the first compartment (70) is sealed except for means for introducing and removing the first liquid from the compartment (70). Preferably the second compartment (72) is sealed except for means for introducing the second liquid into and discharging the second liquid from the second compartment (72).

Preferably the means for transporting the first liquid to the mixing chamber (40) is a connector (10). As the first liquid is preferably water, this connector 10 is preferably attached to the water mains. Preferably the means for transporting the second liquid to the mixing chamber (40) is a pipe (60) connecting the second compartment (72) to the mixing chamber (40). Preferably the two compartment chamber is a pressure transmitting chamber (58), which is divided by a movable separating wall (68) into the two compartments (70, 72).

Preferably the movable separating wall (68) is formed as a bellows comprising a rubber - elastic material.

Preferably the first compartment (70) is connected in series with a switching mechanism (16), through pipe (78) of the jet pump (32).

Preferably the jet pump (32) can be connected via switching mechanism (16) to means (10) for introducing the first liquid into the mixing chamber (40).

Preferably two counteracting one way valves (54,64) are connected in series with the outlet of the second compartment (72), one valve 64 which allows flow of liquid from second compartment (72) via means (60) to the mixing chamber (40) and the other (54) allows flow of liquid from the reservoir(46) into the second compartment (72).

Preferably the switching mechanism (16) is formed by a four-way stopcock with a switching valve (18) having an x-shaped aperture.

Any suction action in the means (pipe 60) for introducing the second liquid into the mixing chamber (40) is undesirable. One reason is that when filling the compartment (72) with the second liquid from the reservoir (46), the water that is expelled from the first compartment (70) flows out through the jet of mixing chamber (40). If suction in means (60) was to occur as the water passed the point of the entry into the mixing chamber (40) of pipe (60), the additive would unnecessarily be drawn up past the one way valve 64 and the shutter or pressure-regulating valve (66), which would result in uneven mixing.

In a preferred embodiment of the invention therefore the mixing chamber 40 is designed so that water is injected into the mixing chamber and the additive is introduced to the water at a point where no suction (that could arise due to the injection of water) occurs. Examples of such a construction may be taken by modifying the jet pumps of p. 172–183 of "Ullmann's Enzyclopädie der technischen Chemie", 4th edition, volume 3, 1973 (Verlag Chemie, Weinheim) the contents of which are incorporated herein by reference, the modification being illustrated with reference to FIG. 3 in which pipe (60) is introduced to the chamber (40) at point (81), a distance away from the head of the jet 82.

A further advantage of the invention is that the second liquid is transported under pressure without requiring outside energy. A constant mixture ratio can be guaranteed in particular since the supply of the second liquid takes place under pressure above atmospheric and is not dependent on a level of suction, as is the case with a jet pump.

The process according to the invention is of particular use in the production of aeroconcrete or mortar in which the first liquid is water and the second liquid is an additive for concrete. The liquids when mixed together are used as mixing water.

In the production of aeroconcrete, the additive is a foam forming agent and the liquids are subsequently passed through a series of foam forming elements such as a foam nozzle prior to their use as mixing water. The use of the process according to the invention enables an extremely even pored aeroconcrete to be attained, due to the constant ratio of mixing of the foam-forming additive to the water and this allows a particular calculated desired strength of the aeroconcrete.

BRIEF DESCRIPTION OF THE DRAWING

An example of operation of the invention will now be described with reference to the drawings in which.

EXAMPLE 1

Figure 1:
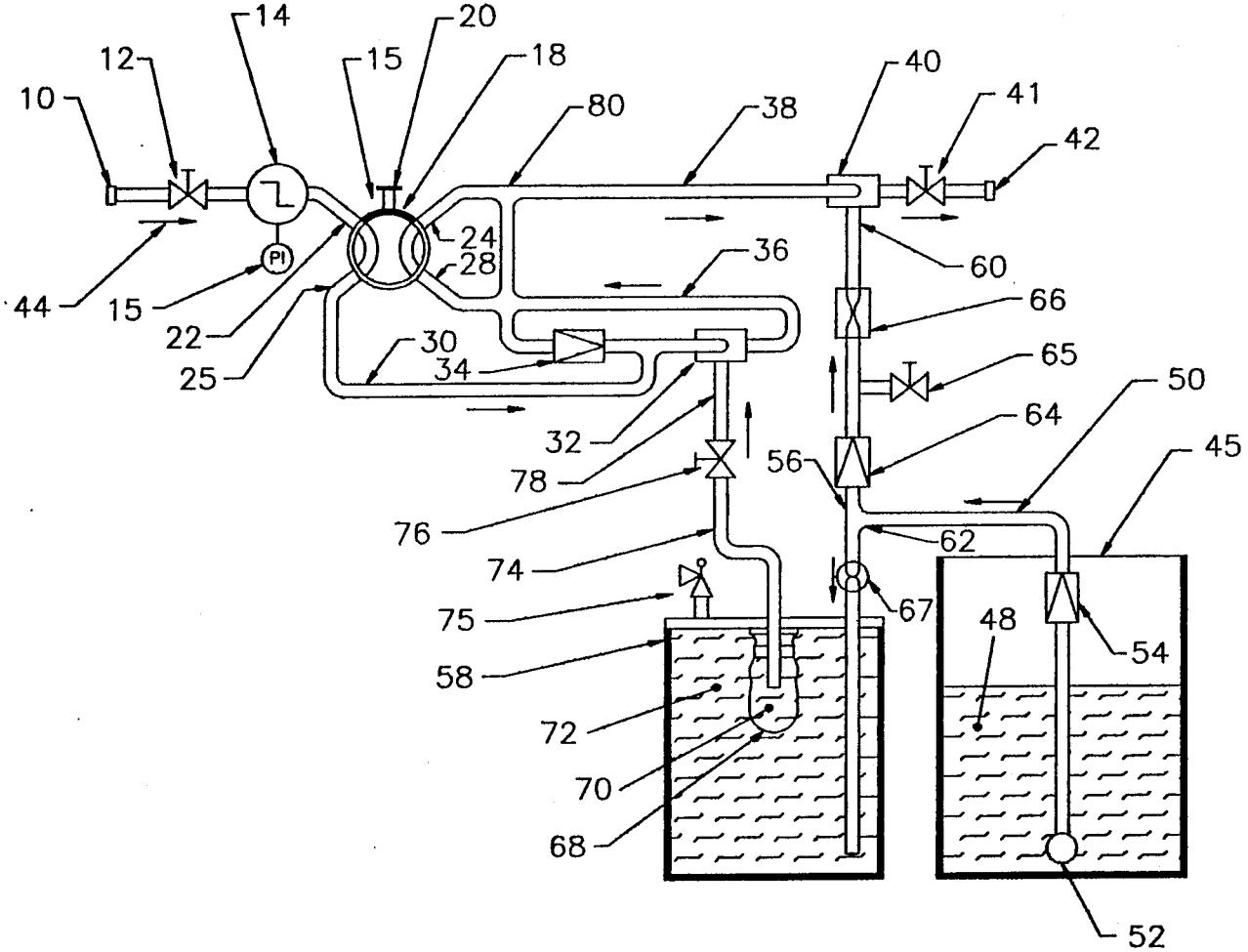
FIG. 1 is a diagram of an apparatus set for filling the second liquid in compartment (72) of the chamber (58)
Figure 2:
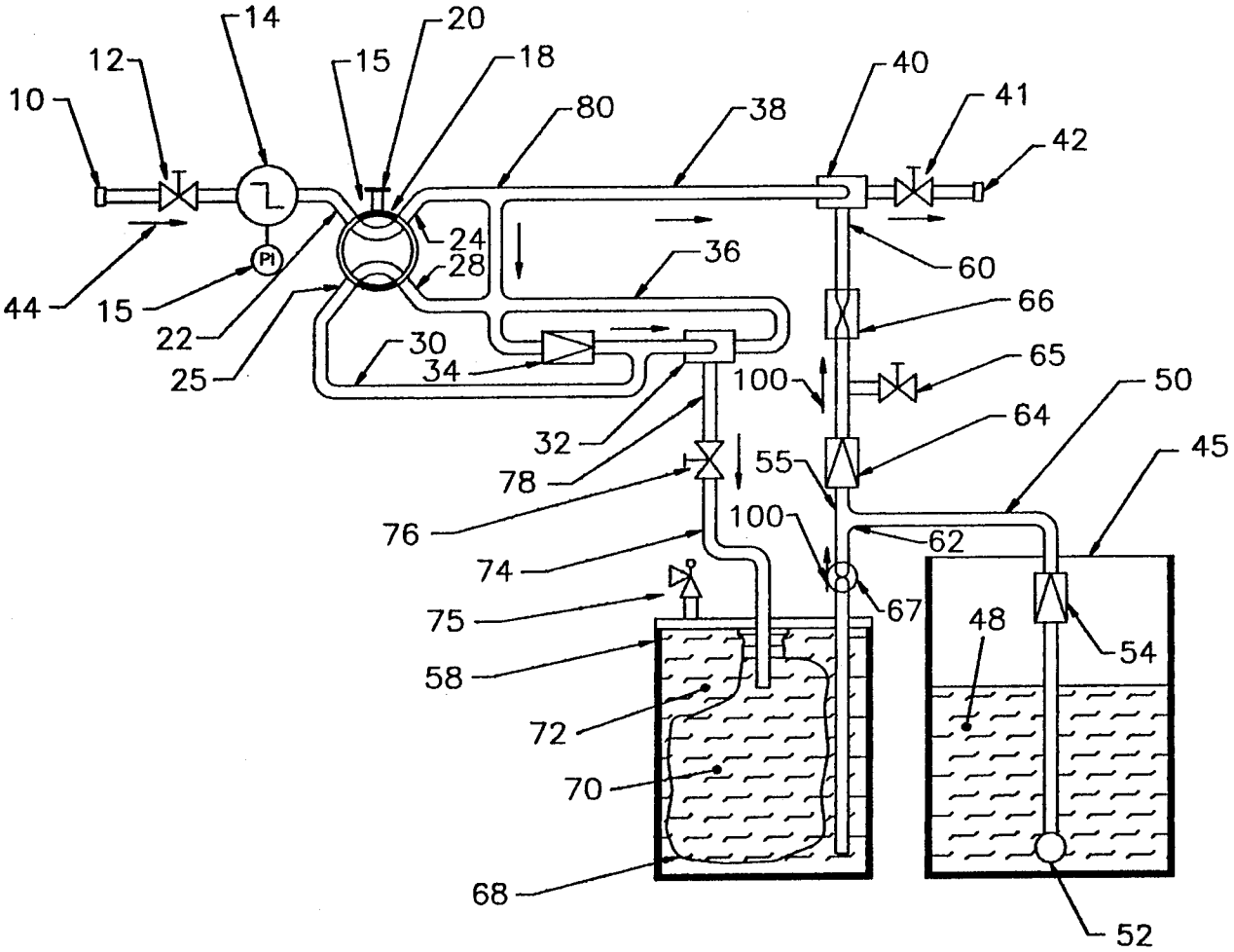
FIG. 2 is a diagram of the apparatus according to FIG. 1 set for mixing.

The apparatus illustrated in the drawing is used to mix two liquids, the first of which is brought under excess pressure to a mixing chamber 40 whereas the second is brought to the mixing chamber 40 from a pressure transmission chamber 58. The first liquid is tap water from a mains supply, and the second liquid is a foam-forming additive. The resultant mixture of mains water and foam-forming additive can be employed for example as mixing water for the production of aeroconcrete. FIGS. 1 and 2 however only show the elements required for mixing. The foam-producing elements which are not illustrated are connected in series with outlet 42.

The apparatus of FIG. 1 has a water pipe connector 10, to which are connected in sequence a stopcock 12 and a pressure-reducing valve 14 to which a manometer 15 is attached. The pressure-reducing valve 14 is set for example at 2 bars. The pressure-reducing valve 14 is connected to a four-way stopcock 16 which acts as a switching mechanism, together with switching valve 18 which has an x-shaped aperture. The stopcock 16 can be regulated manually by a handle 20. The four connectors of the stopcock 16 are designated 22, 24, 26 and 28.

In FIG. 1 which shows filling of compartment 72 with additive, the switching valve 18 is positioned to connect the connector 22 with connector 26 and connector 24 with connector 28. Consequently, the outlet from the pressure-reducing valve 14 is joined via the connectors 22 and 26 and via a pipe 30 to a water jet pump 32 for withdrawing water from compartment 70. Non-return valve 34 prevents back-flow from pipe 30 by-passing the pump 32 to pipe 38. The outlet of the water jet pump 32 passes via connecting pipe 36 which leads to connector 28 of the stopcock 16 and leaves stopcock 16 through connector 24 by means of connecting pipe 38 to a mixing chamber 40. The connecting pipe 38 creates a jet of liquid entering mixing chamber 40.

Figure 3:
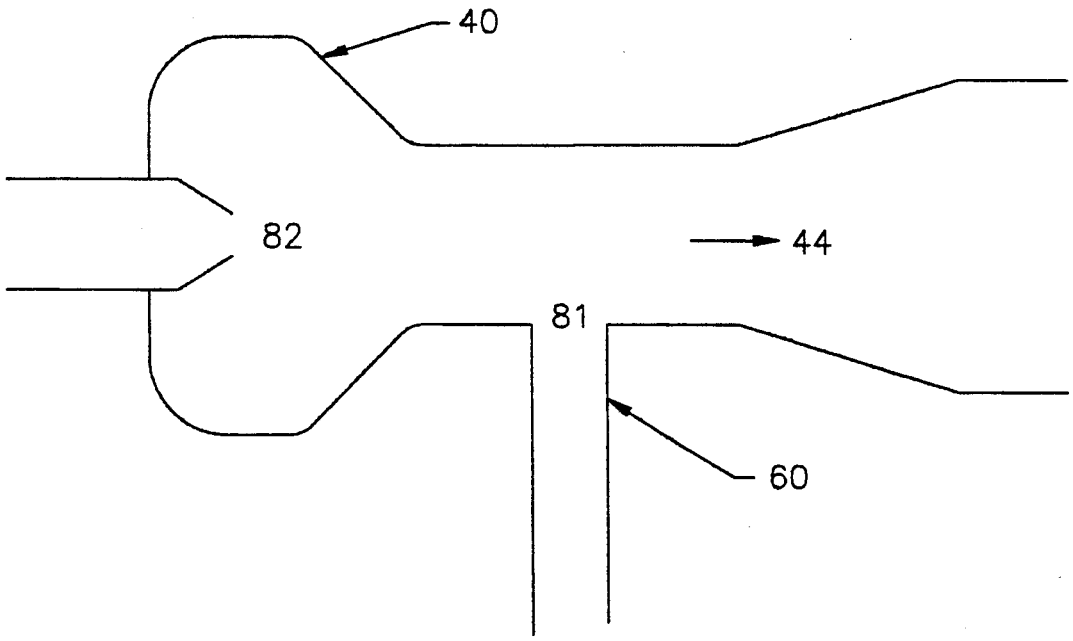
FIG. 3 is a diagram showing the modified mixing chamber 40.

The supply of the second liquid (via a second supply pipe 60 which leads in) to mixing chamber 40 (as can be seen in FIG. 3 ) is located at such a point that the jet of water does not cause any suction action. The outlet of the mixing chamber 40 is connected to a connector 42. Arrow 44 shows the direction of flow of water from the mains to the mixing chamber 40.

The second liquid 48 is stored in a reservoir 46. A capillary action pipe 50 with a filter 52 downstream of said pipe and a second nonreturn valve 54 are located in reservoir 46. The filter 52 and the second nonreturn valve 54 are illustrated separately, although these usually form a single unit.

The capillary action suction pipe 50 is connected to a pipe 56. Pipe 56 connects operating chamber 58 acting as a pressure transmitter with pipe 60 that is connected to the mixing chamber 40. Between the junction 62 and the mixing chamber 40, a nonreturn valve 64 is located in sequence with a pressure-regulating valve on shutter 66. Valve 64 allows fluid to flow from the pipe section between junction 62 (of pipes 50 and 56) and the mixing chamber 40 in the direction towards the mixing chamber 40. Pipe 56 contains a flow gauge 67. Further an access stopcock 65 is located between shutter 66 and the non-return valve 64. Stopcock 65 allows the pipe portion between the junction 62 and the mixing chamber 40 to be washed through.

The pressure transmission chamber 58 is separated into two closed compartments 70 and 72 by bellows 68 forming a moveable separating wall. Compartment 70 is filled with the first liquid (i.e. water) and the compartment 72 is filled with the second liquid (i.e. the additive) 48. Chamber 58 is air-free. This enables direct transfer of pressure from the first liquid in compartment 70 to the second liquid in compartment 72 to take place without any air or compressible gas interfering. Compartment 70 is connected by a pressure-and suction-pipe 74 and by a second stopcock 76 to connector 78 of the water jet pump 32. Further chamber 58 has a pressure release (blow out) valve 75 in case the pressure exceeds a predetermined maximum.

The operation of the apparatus of FIGS. 1 and 2 will be described below:

i) FILLING OPERATION of Compartment 70 with additive 48, (see FIG. 1)

The four-way stopcock 16 is shown in the "filling" position (i.e. connector 22 connects to connector 26 and connector 24 connects to connector 28). The operating container 58 is filled from the supply container 46 with the additive 48. To do so, the water originally from the mains is pumped out of compartment 70 in the direction of the arrow 44 via the water jet pump 32 back to the four-way stopcock 16 and out of the apparatus through the mixing chamber 40 which is not in operation as a mixing chamber and merely serves as a conduit to the outlet connector 42.

The water jet pump 32 causes the water to be drawn out of the first compartment 70 of the operating container 58 past its connector 78 and through the pressure-and suction-pipe 74. Due to the resulting contraction of the movable wall (bellows) 68, the first compartment 70 shrinks, and consequently the volume of the second chamber 72 enlarges, thereby drawing the additive 48 by suction from the supply container 46 through the filter 52 and the second nonreturn valve 54 into the second compartment 72. As soon as the second compartment 72 of the operating container 58 has been filled, the stopcock 12 is closed. The four-way stopcock 16 is then manually rotated to its mixing position (i.e. connector 22 connects to connector 24 and connector 26 connects to connector 28 (see FIG. 2) and the apparatus is ready for operation for the mixing procedure.

ii) MIXING OPERATION (see FIG. 2)

Stopcock 12 is opened allowing mains water to flow from connector 10 to connector 22 of the four-way stopcock 16 which is in the mixing position. Water therefore passes to connector 24. Most of the water flows via the connecting pipe 38 to the mixing chamber 40 and on to outlet 42. However some of the water branches at the junction 80 and flows through first nonreturn valve 34 which is actuated to allow the water to flow to jet pump 32, which is not in operation as a jet pump and therefore acts as a conduit to connector 78 and stopcock 76 through pipe 74 into the first compartment 70 of the pressure transmission chamber 58. The additive is consequently displaced from the second compartment 72 through pipe 56 in the direction of arrow 100 to the mixing chamber 40 where it is mixed with the mains water from pipe 38. The second nonreturn valve 54 prevents flow-back of additive into the supply container 46.

Second stopcock 76 should be closed when the apparatus is to be washed out with mains water supplied via the water pipe connector 10, either in the position "filling" or in the position "mixing" of the four-way stopcock 16.

Constant regulation of pressure occurs since the two compartments 70 and 72 of the pressure transmission chamber 58 do not have any compressible medium (i.e. air or gases) present. This enables good control therefore of the mixture ratio of water and additive 46.

The mixture ratio is not dependent on any level of suction nor especially on the viscosity of the additive since the additive is expelled from compartment 72 by excess pressure generated by the expansion of compartment 70.

FIG. 3 shows the mixing chamber 40 in more detail. By locating the junction of pipe 60 with the mixing chamber 40 at point 81, a distance away from the head of the jet 82, the jet will not cause any suction effect at the point of mixing the water with the additive that enters the mixing chamber 40 through pipe 60. This ensures that mixing is controlled by the regulating means to create an even mix of the water and additive.

I claim:

1. A process for mixing water from a pressurized source and an additive or admixture for a cementitious composition from a reservoir in a mixing chamber (40) comprising introducing, water under a first pressure, which is above atmospheric pressure, and introducing the additive under a second pressure between atmospheric pressure and the first pressure, the amount of the additive that is introduced to the mixing chamber being controlled by regulating means regulated by the pressure of water, the regulating means including a two compartment pressure transmission chamber (58), into the first compartment (70) of which water passes and into the second compartment (72) of which the additive passes, the two compartments (70 and 72) being separated by a movable wall (68), whereby in operation the first compartment (70) is filled with water and is expanded or contracted by introduction or removal of said water respectively thereby changing the volume of the second compartment (72) causing expulsion of the additive to the mixing chamber (40) and subsequent expansion of the second compartment (72) allowing additive to be drawn from reservoir (46).

2. A process according to claim 1 in which the regulating means are controlled by hydrostatic pressure from the source of water.

3. A process according to claim 1 comprising introducing the additive or admixture into the second compartment from a reservoir by means of discontinuous filling and displacing the additive or admixture from the compartment by pressure derived from the water.

* * * * *